US005441230A

United States Patent [19]

Sambleson

[11] Patent Number: 5,441,230

[45] Date of Patent: Aug. 15, 1995

[54] DECORATIVE ACCESSORY WALL SUSPENSION SYSTEM

[75] Inventor: William W. Sambleson, 8343 Lakedale Cir., Colfax, N.C. 27235

[73] Assignee: William W. Sambleson, High Point, N.C.

[21] Appl. No.: 170,812

[22] Filed: Dec. 21, 1993

[51] Int. Cl.[6] ..... A47G 1/16

[52] U.S. Cl. ..... 298/495; 52/98

[58] Field of Search ..... 52/98, 99, 160; 40/152.1, 617; 248/159, 323, 475.1, 495, 496, 544, 909

[56] References Cited

U.S. PATENT DOCUMENTS 2,448,588 9/1948 Greenberg ..... 248/495

3,241,796 3/1966 Asler et al. ..... 248/495 X

*Primary Examiner*—Carl D. Friedman

*Assistant Examiner*—Creighton Smith

[57] ABSTRACT

A system of suspension components is provided that includes a wall bracket and a device having a pair of spreadable arms for attaching to said wall bracket. The device can be used to suspend picture frames or the like and is adjustable for various size frames. The arms of the device include a series of frangible segments that can be easily, manually removed by bending a segment at its juncture. Also included are extension members that can be easily affixed to the arms to provide additional length when necessary. The extension members likewise are formed from frangible segments, which can be broken away for length adjustment.

16 Claims, 2 Drawing Sheets

DECORATIVE ACCESSORY WALL SUSPENSION SYSTEM

BACKGROUND OF THE INVENTION

1. Field Of The Invention

The invention herein pertains to a decorative accessory wall suspension system for use in homes, offices or the like for hanging or suspending decorative accessories such as framed pictures and other decorative accessories in place on conventional sheetrock or other types of walls.

2. Description Of The Prior Art And Objectives Of The Invention

In recent years it has become more fashionable to frequently refurnish and redecorate rooms in homes, office buildings and institutions. More and more emphasis and attention has been placed on replacing and changing wall hangings such as framed pictures and decorators are constantly seeking simple solutions to the age-old problem of easily hanging and aligning framed pictures and paintings. In the past, a wall bracket has been devised which can be driven into and mounted on a sheetrock (dry) wall and a picture frame holding device attached thereto which has spreadable arms rotatably attached to a bracket plate to accommodate various sized picture frames. The arms have apertures near their distal ends whereby a small screw can be placed therethrough into the picture frame to hold the arms in place on each side of the frame. While such prior devices have proved somewhat satisfactory, oftentimes the pictures so hung must be changed for one larger or smaller, and the arms will not accommodate the new frames.

Thus, with the disadvantages and problems associated with prior art picture frame hanging devices, the present invention was conceived and one of its objectives is to provide a component system that is more versatile for maintaining picture frames or the like securely on walls.

It is another objective of the present invention to provide a decorative accessory wall suspension system which utilizes a bracket plate having a somewhat Z-shape to increase convenience of its use.

It is still another objective of the present invention to provide a decorative accessory wall suspension system which includes a pair of spreadable arms which include a plurality of elongated segments.

It is also an objective of the present invention to provide a decorative accessory wall suspension system which includes spreadable arms having elongated segments which are divided by arcuate grooves whereby the arms are easily breakable within the grooves to adjust the lengths of the arms as required.

It is a further objective of the present invention to provide a decorative accessory wall suspension system having extension members whereby the arms can be selectably extended by joining the extension members to the swingable arms.

It is yet still another objective of the present invention to provide a decorative accessory wall suspension system which includes a pair of spreadable extension members which include a plurality of elongated segments.

Various other objectives and advantages of the present invention will become apparent to those skilled in the art as a more detailed description is set forth below.

SUMMARY OF THE INVENTION

The aforesaid and other objectives are realized by providing a decorative accessory wall suspension system, having a pair of spreadable arms, which is affixed to a wall bracket to hang an object such as a picture frame therefrom for decorating or other purposes. The arms of the device are rotatable at their riveted juncture and each arm is composed of a series of elongated segments. The segments are attached one to another through arcuate grooves which provides a breakable joint. Thus, the arms can be easily broken to form a length of selected dimensions by manually bending at the joint approximately two to three times until the end or terminal segment snaps free. Each segment has an aperture which allows the arm to be attached, such as with a small screw or nail, for example, to a wooden picture frame. The conventional wall bracket to which the device is attached includes a series of nibs for urging into a vertical panel such as wall board, sheetrock, wood or the like and has a hook for receiving a bracket plate. The bracket plate, with the arms rotatably attached, has a somewhat Z-shape to allow the arms to have room and freedom of movement by spacing them slightly from the wall and wall bracket.

Each of the breakable arm segments also include small latch openings through which latch members of an extension member can be attached in the event that the arms do not have sufficient length for a large sized picture frame. The extension members are shaped somewhat like the arms to which they attach in that each extension member is formed with an elongated, planar shape and also includes a series of frangible segments. A series of latches are attached to certain of the frangible segments for cooperatively engaging the latch openings in the extension members to releasably affix the arms to the extension members as required. As would be understood, the extension members are used when necessary for suspending objects such as large wooden picture frames which have dimensions greater than that which can be accommodated with the spreadable arms alone.

DESCRIPTION OF THE PREFERRED EMBODIMENT

The preferred form of the invention is illustrated in FIGS. 1–5 whereby a device is presented for hanging framed pictures or the like to a vertical wall. A conventional wall bracket having a series of nibs is placed at an appropriate location on the wall and is urged into the wall, by simply pushing or by tapping with a hammer, whereby the nibs penetrate the surface of the wall. The wall bracket has an extending hook to which the device is affixed through an opening in a small Z-shaped bracket plate. The spreadable arms in the preferred embodiment extend 10.25 inches and can accommodate picture frame sizes of from six to thirty-four inches wide when used with extension members. The arms of the device are formed from cast metal such as cold rolled steel plated with zinc coating and include a first base segment approximately four inches long and a series of six shorter elongated segments, which are approximately one inch long, and are attached, one to another, along an arcuate slot therein. Each arm is approximately 0.5 inches wide and 0.032 inches thick. Each arm segment has a terminal aperture for receiving a securing member, such as a threaded screw or nail, to attach to, for example, a wooden picture frame. Certain of the elongated segments also include a series of rectangularly shaped latch openings.

For large sized picture frames, the wall suspension device can be used in conjunction with two extension members, each of which also include a long base segment and a series of frangible segments having L-shaped latches which pass through the latch openings in the spreadable arms for cooperative engagement therewith. The wall suspension device as described can accommodate any of a variety of pictures or other objects of various sizes and will suspend objects from a vertical wall with ease and convenience. As would be understood, the length of the arms or extension members can be adjusted by manually bending the segments at the arcuate shaped grooves to "snap" off the arm or extension member segments at a desired, selected length.

DETAILED DESCRIPTION OF THE DRAWINGS AND OPERATION OF THE INVENTION

Figure 2:
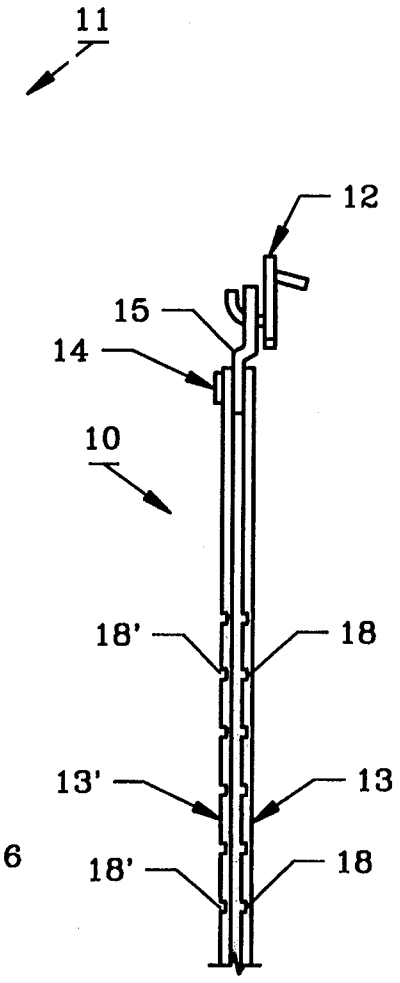
FIG. 2 shows an enlarged partial side elevational view presented in FIG. 1 with a wall bracket plate.
Figure 1:
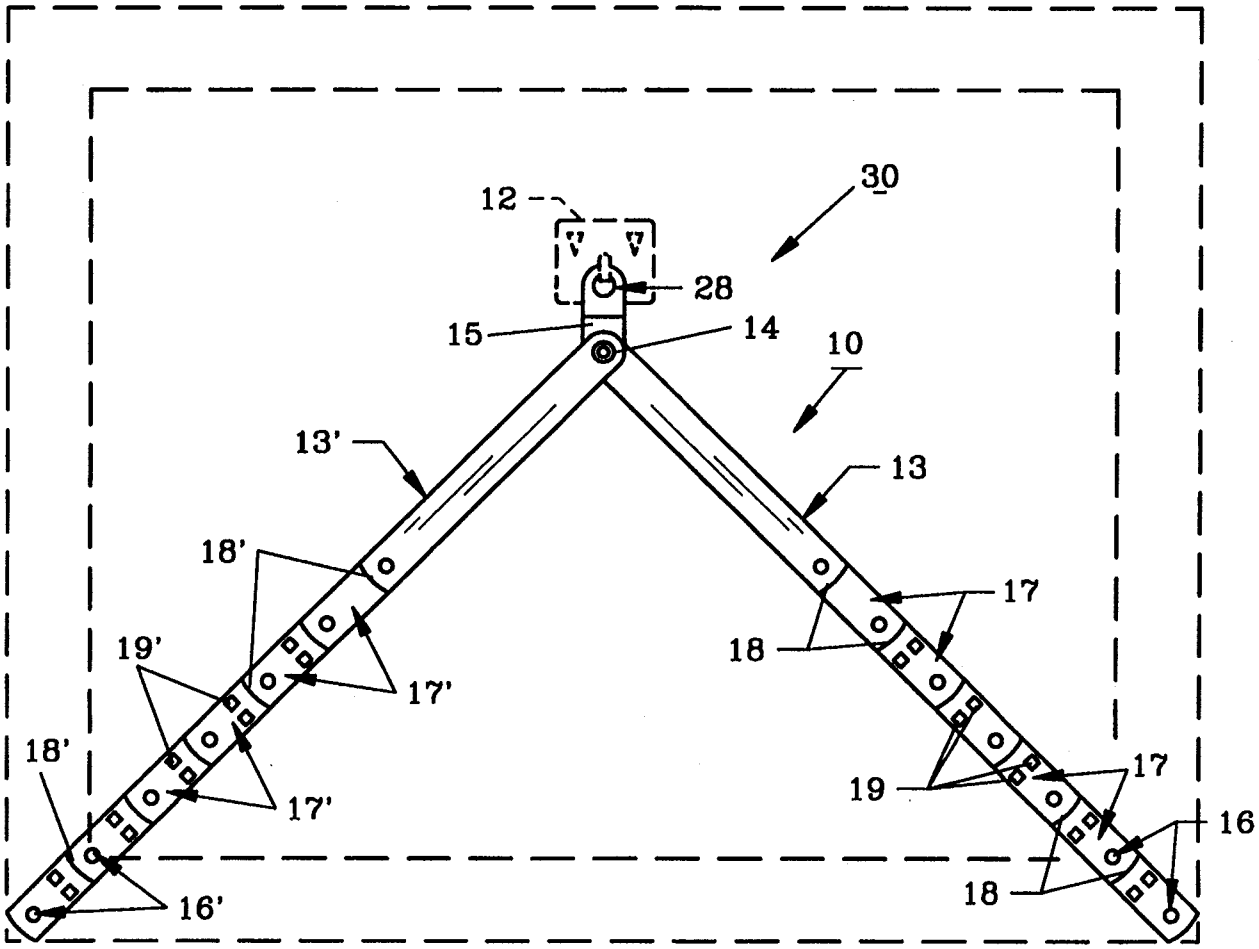
FIG. 1 shows a top plan view of the suspension system of the invention illustrating a device with a pair of spreadable arms which are separated approximately ninety degrees and pivotally affixed to the bracket plate.

For a better understanding of the suspension system of the invention and its operation, turning now to the drawings, FIG. 1 illustrates wall suspension device 10 as would be attached to picture frame 11, seen in outline form for clarity. As would be understood, picture frame 11 is but one of many decorative accessories which may be suspended from a wall or other vertical structure by the use of suspension device 10. Suspension device 10 is affixed to standard wall bracket 12, as shown in outline form, as illustrated in FIG. 2. Wall bracket 12 is urged, by pushing firmly or by tapping with a hammer, into a sheetrock wall or the like where it is held securely in place.

As further seen in FIG. 1, a pair of spreadable arms 13, 13' are rotatably joined by rivet 14 to Z-shaped bracket plate 15. Arms 13, 13' are spreadable as they pivot around rivet 14 and are adjustable to any of a variety of shaped and sized objects. As seen in FIG. 1, small screws could be placed through apertures 16, 16' for attachment to frame 11. In the event arms 13, 13' are of excessive length, six elongated segments 17, 17' are frangible in that they are easily breakable along arcuate grooves 18, 18' by manually bending back and forth. Arms 13, 13' may be, for example, 10.25 inches in total length, 0.5 inches wide and approximately 0.032 inches thick. Grooves 18, 18' are approximately 0.015 inches deep and 0.010 inches wide. Segments 17, 17' can be easily "snapped off" by manually bending along groove 18, 18' two or three times, back and forth.

Figure 5:
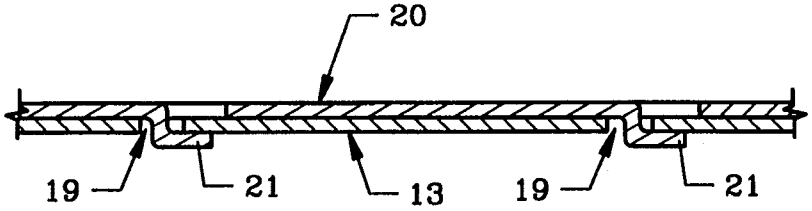
FIG. 5 illustrates an enlarged partial cross-sectional side view of one of the arms as shown in FIG. 1 attached to a section of the extension member to illustrate the engagement thereof.
Figure 4:
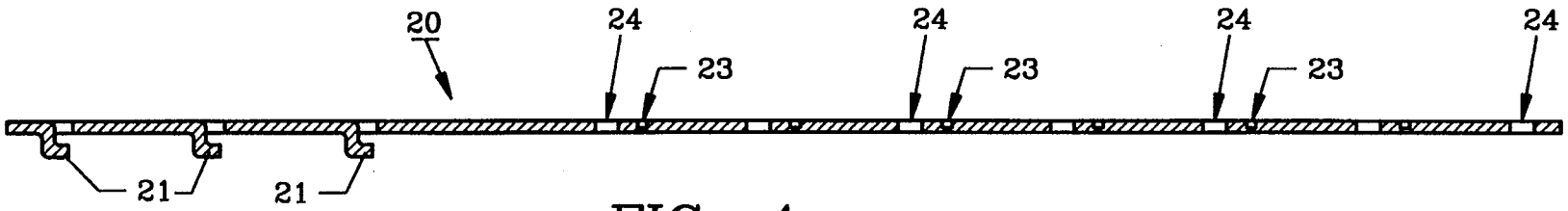
FIG. 4 pictures a cross-sectional view of the extension member as seen in FIG. 3 along lines 4—4.
Figure 3:
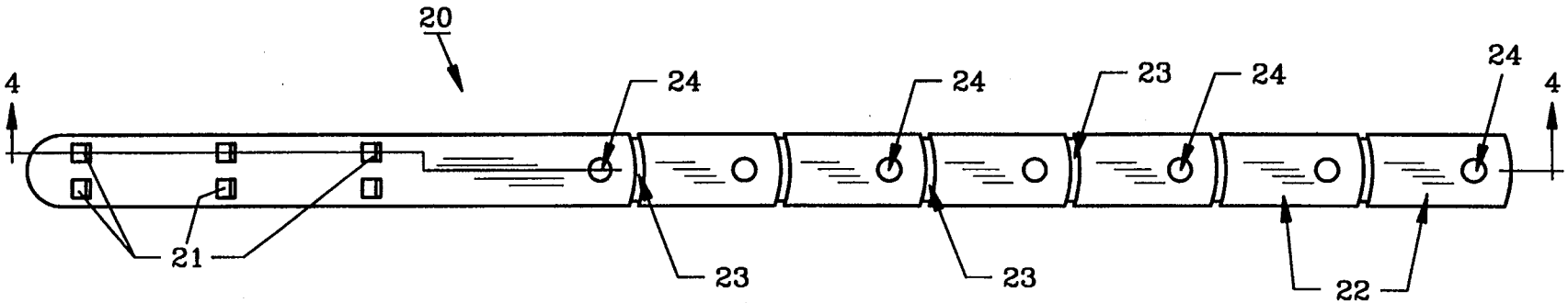
FIG. 3 demonstrates a top view of one extension member as used herein.

In FIG. 3 a top view of extension member 20 is shown which, like arms 13, 13', includes a series of frangible elongated segments 22 joined at arcuate grooves 23. Openings 24, like openings 16 as shown in FIG. 1, provide a means for receiving a securing member such as a threaded screw or nail (not shown) for affixing extension member 20 to a picture frame. Extension member 20 also includes a series of latches 21 and six such latches are shown in FIG. 3 for engagement with latch openings 19, 19' of arms 13, 13'. FIG. 5 shows a close-up view of the engagement of latches 21 though openings 19 and, as would be realized to those skilled in the art, two such extension members 20 would be utilized, one for attachment to arm 13 and the other attachment to arm 13'. Extension member 20 of course is utilized when the lengths of arms 13, 13' need to be increased. FIG. 4 pictures a cross-sectional view of extension member 20, as seen in FIG. 3, along lines 4—4.

Decorative accessory wall suspension system 30, which includes conventional wall bracket 12 and suspension device 10, as seen in FIG. 1, provides a unique method of hanging pictures or other decorative accessories. In use, the center of the width of a picture frame such as frame 11 is determined as with the use of a ruler and is marked along the back top inside edge of the frame with a pencil or the like. Next, a second mark is made one inch directly below the top center line mark on the back of the picture. Bracket plate opening 28 is placed over the second mark and while so positioned, left and right spreadable arms 13, 13' are moved to the sides of the frame, as seen in FIG. 1, where they are correctly sized (broken away along grooves 18, 18'), as earlier explained, and are attached such as with small screws through openings 16, 16' respectively. Additional picture frames, as are to be used in the room at the same wall height, are also so marked and with wall suspension device 10 affixed, all the pictures in the room can be hung at a precise, identical height without accounting for sagging wires or other hanger variations as have heretofore been encountered.

The illustrations and examples provided herein are for explanatory purposes and are not intended to limit the scope of the appended claims.

I claim:

1. In a suspension system with a device having a pair of spreadable arms for attachment to a wall bracket whereby the arms are affixed to an object to suspend said object from the wall bracket, the improvement comprising: a plurality of elongated arm segments, said segments joined end-to-end in frangible relation to form an arm, each of said arm segments having an outer surface which defines an aperture.

2. The suspension system of claim 1 wherein one of said arm segments has an outer surface which defines a latch opening.

3. The suspension system of claim 1 and including an extension member, said extension member attachable to one of said arm segments.

4. The suspension system of claim 3 and including a latch, said latch attached to said extension member.

5. The suspension system of claim 4 wherein said latch is L-shaped.

6. The suspension system of claim 3 wherein said extension member comprises a plurality of elongated segments, said segments attached end-to-end in frangible relation, each of said segments having an outer surface which defines an aperture.

7. The suspension system of claim 6 and including a plurality of L-shaped latches, said latches affixed to said extension member.

8. The suspension system of claim 1 and including a bracket plate, said arms pivotally joined to said bracket plate.

9. The suspension system of claim 1 wherein said elongated arm segments are formed of metal.

10. The suspension system of claim 1 wherein said arm segments are joined in an arcuately frangible relation.

11. In a frame suspension system with a device for retaining a picture-like frame wherein said device has a pair of spreadable arms which extend to receive the frame and is attached to a wall bracket, the improvement comprising: each of said arms comprising a plurality of segments, said segments joined one to another in frangible relation and each of said segments having an outer surface which defines an aperture.

12. The suspension system of claim 11 and including a pair of extension members, said extension members each having a latch, said latch for attaching one of said extension members to one of said arms.

13. The suspension system of claim 11 wherein said latch is substantially L-shaped.

14. The suspension system of claim 11 wherein said arm segments each have a surface which defines a plurality of latch openings, a pair of extension members, said extension members each comprising a latch, said latch for selectively positioning in said latch openings to attach said extension members to said arm segments.

15. The suspension system of claim 11 wherein said arm segments are joined in an arcuately frangible relation.

16. The suspension system of claim 11 and including a bracket plate, said bracket plate being somewhat Z-shaped, said arms pivotally joined to said bracket plate.

* * * * *